US006748096B2

(12) United States Patent
Chuang

(10) Patent No.: US 6,748,096 B2
(45) Date of Patent: Jun. 8, 2004

(54) BULB TYPE SPEAKER STRUCTURE

(76) Inventor: Pao-An Chuang, 12F-2, No. 376, Tun Hwa South Rd., Sec. 1, Taipei (TW)

( * ) Notice: Subject to any disclaimer, the term of this patent is extended or adjusted under 35 U.S.C. 154(b) by 96 days.

(21) Appl. No.: 10/187,978

(22) Filed: Jul. 3, 2002

(65) Prior Publication Data

US 2004/0005072 A1 Jan. 8, 2004

(51) Int. Cl.[7] ..... H04R 25/00

(52) U.S. Cl. ..... 381/395; 381/386; 381/390; 181/150

(58) Field of Search ..... 381/386, 388, 381/390, 395; 181/150, 149; 340/656; 455/346

(56) References Cited

U.S. PATENT DOCUMENTS 4,776,018 A * 10/1988 Cordier ..... 381/333
4,963,854 A * 10/1990 Stuecker ..... 381/387
5,828,765 A * 10/1998 Gable ..... 381/386

* cited by examiner

*Primary Examiner*—Suhan Ni
(74) *Attorney, Agent, or Firm*—Troxell Law Office PLLC

(57) ABSTRACT

A bulb type speaker structure mainly comprises a speaker, a circuit board, and a case body. The circuit board is lodged inside of a housing of said case body. Leads connect an inside conductor and an outside one of a joint of the case body to an AD adaptor of the circuit board respectively. The speaker is set in the remaining space inside the housing and connected to an amplification circuit of the circuit board with leads. A safeguard combined to the opening of the housing can seal and form the bulb type speaker structure. Such bulb type speaker can be easily connected with a bulb holder through the joint of the case body so as to perform its facility and maneuverability of installation without additional stands.

3 Claims, 5 Drawing Sheets

BULB TYPE SPEAKER STRUCTURE

BACKGROUND OF THE INVENTION

The present invention is related to a bulb type speaker structure, more particularly, to a bulb type speaker structure with a joint analogous to that of a bulb so it can be connected to a bulb holder habitually used and can be easily installed without additional stands.

DESCRIPTION OF PRIOR ART

The structure of conventional speakers is mainly consisted of a box and a cover board wherein there is an opening in the rear of the box and a loudspeaker in the front. Besides, inside the speaker there are columns at intervals for transformer installation. Moreover there are other columns equipped at the four corners of the box. The cover board is suit with and attached to the opening of the box to form a cabinet. The speaker structure described above is large, heavy, and restricted with traditional transformer. Further, the transmission techniques were not skillful that it need broadcast apparatus to output and lines of active-amp to connect, and consequently it is great limited in use: every speakers have to be wired; it is inconvenient to supply power; changing positions after installation needs to pull wires afresh; it is not plug-and-play that the installation is time-consuming and immobile especially in arranging large outdoor convocations.

In order to improve the conventional speakers, the present invention is devised to be connected easily with usual bulb adaptors, be installed conveniently with reduced wires, and promote aesthetic and mobility.

SUMMARY OF THE INVENTION

The object of the present invention is to provide a bulb type speaker structure, which can be easily installed on usual bulb holders without any stands in addition.

Another object of the present invention is to provide a bulb type speaker structure, which is not space occupying and is plug-and-play with high mobility.

To accomplish the objects above, the bulb type speaker structure is consisted of a speaker, a circuit board, and a case body. Said circuit board is lodged inside a housing of said case body. Leads connect an inside conductor and an outside one of the joint of said case body to the AD adaptor of said circuit board respectively. Said speaker is set in the remaining space inside said housing and connected to an amplification circuit of said circuit board with leads. A safeguard combined to the opening of said housing can seal and form the bulb type speaker structure. Such bulb type speaker can be easily connected with usual bulb holder through a joint of said case body so as to perform its facility of installation without additional stands.

BRIEF DESCRIPTIONS OF THE DRAWINGS

DETAILED DESCRIPTION OF THE PREFERRED EMBODIMENT

Figure 1:
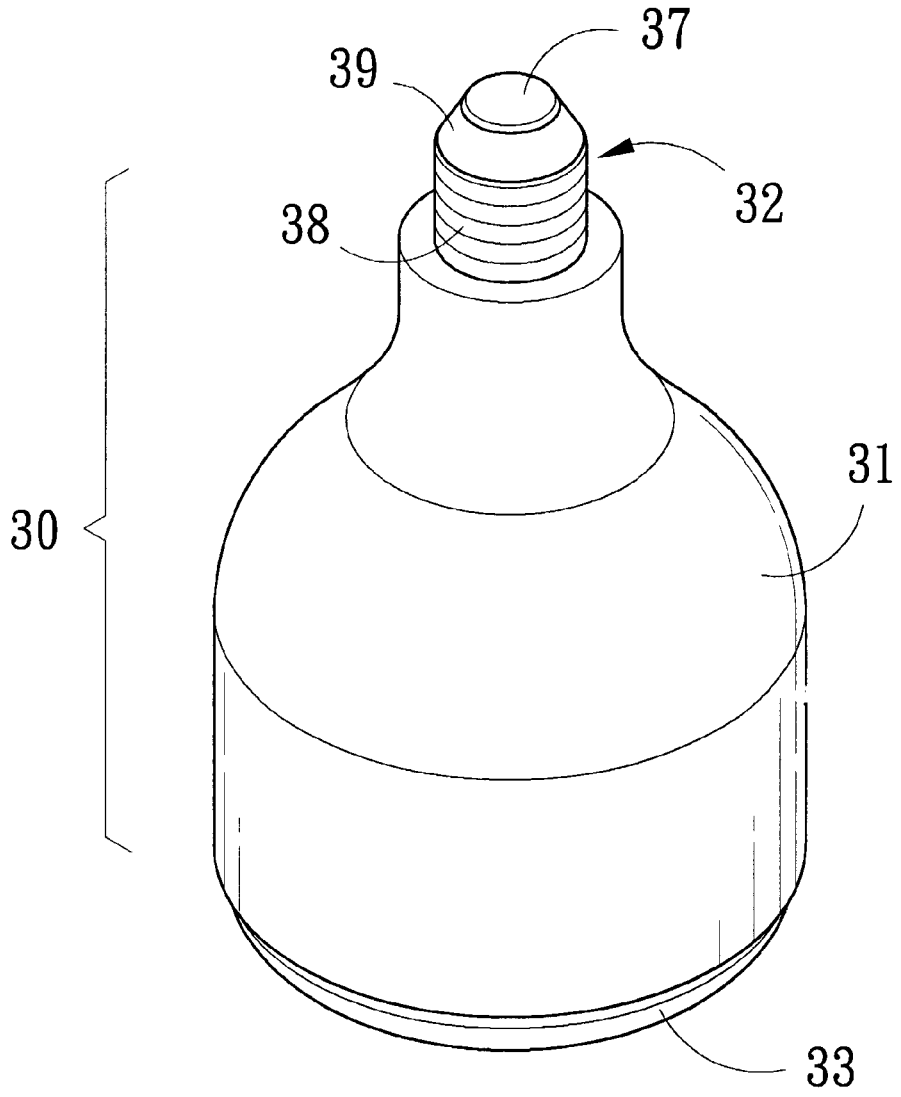
FIG. 1 is a perspective view of an embodiment of the present invention.
Figure 2:
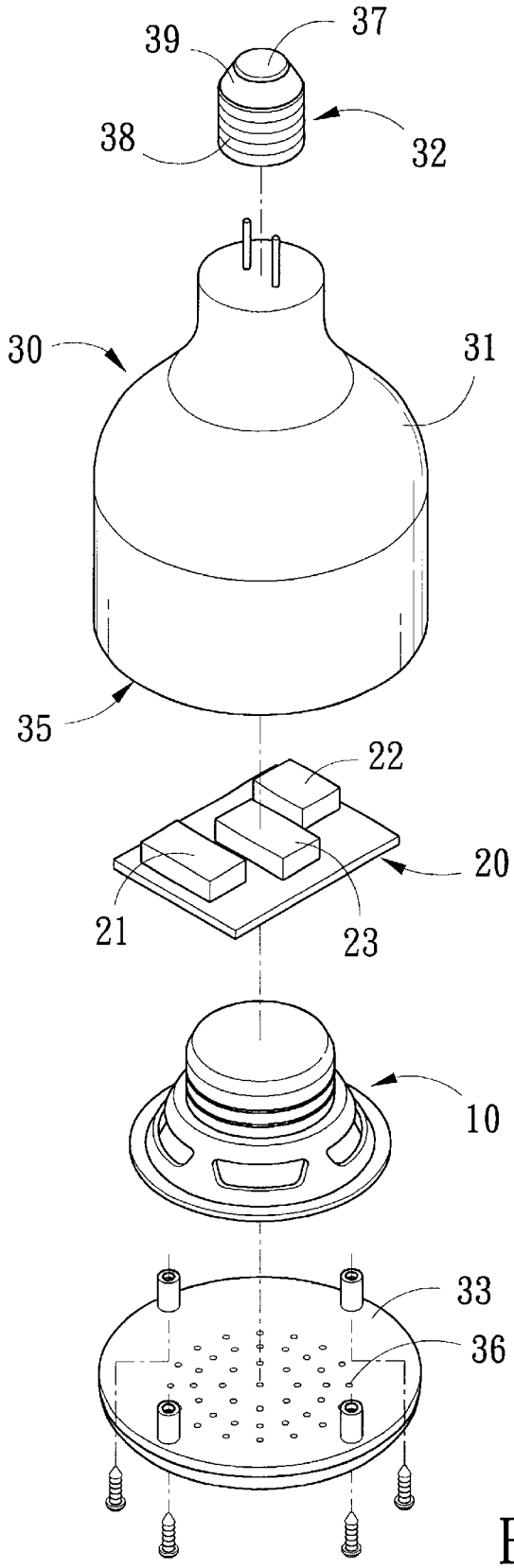
FIG. 2 is an explosion view of the FIG. 1.

Please refer to FIGS. 1 and 2. This invention is for a kind of bulb type speaker structure, including a speaker 10 and a circuit board 20 and a case body 30.

Said speaker 10 is to receive the code of signals transmitting from the circuit board 20 and produce sound.

Said circuit board 20 has an AD adaptor 21, an reception circuit 22 and an amplification circuit 23. Said AD adaptor 21 is to transform the power supply of usual use (110 V or 220 V alternating current) into that used in the reception circuit 22 and amplification circuit 23 (5 V, 12 V, etc. direct current), and said reception circuit 22 can receive external signals in wired or cordless style, and said amplification circuit 23 amplifies the signals received from the electric circuit 22 and then produces sound through said speaker 10.

On the case body 30 there established a housing 31, a joint 32 and a safeguard 33. Said housing 31 is designed as a pour bowl, inside which arranged said circuit board 20 and said speaker 10; there is an opening 35 at the front end of said housing 31 and can be combined with the safeguard 33; said safeguard 33 is established to be a board which can be connected to the opening 35; on the surface of said safeguard 33 there are plurality of sound holes 36 benefit for sound transmission; and on another end of said housing 31 there established said joint 32; said joint 32 has two conductors, inside 37 and outside one 38, with a layer of insulator 39 between them, and there are whorls on the surface of the outside conductor 38 to form an analogue of bulb adapters.

Figure 3A:
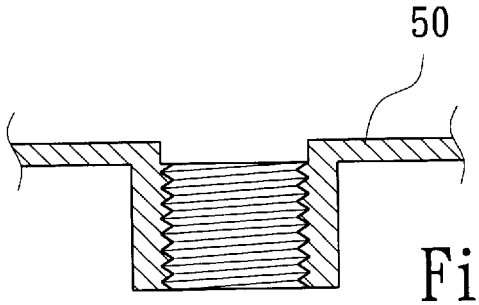
FIG. 3A is a cross-sectional view of a commonly used lamp holder.
Figure 3:
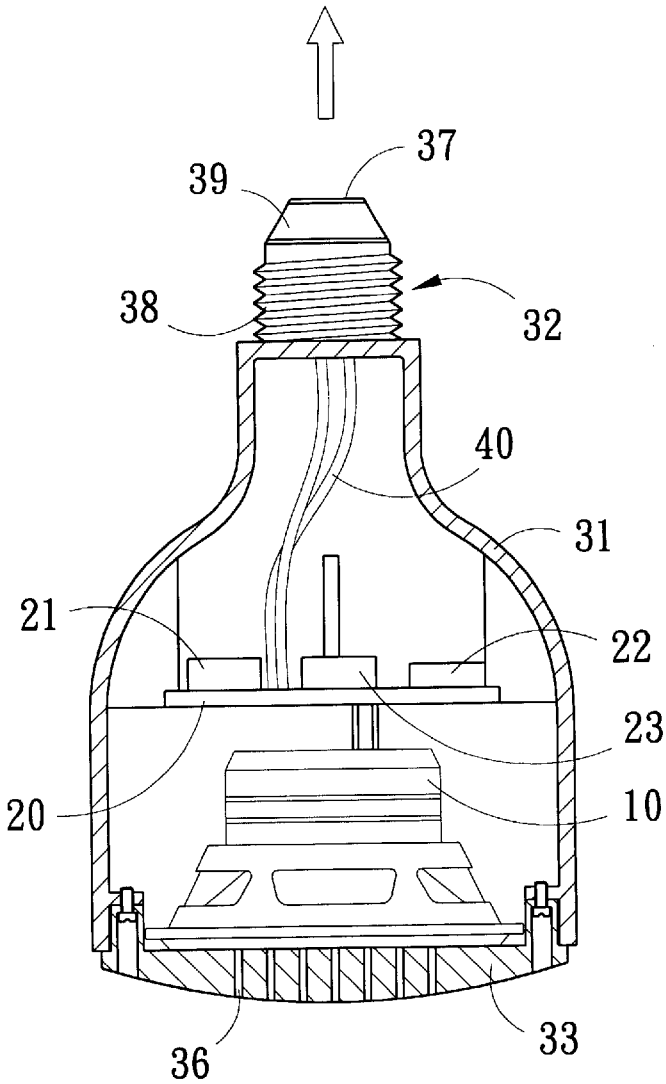
FIG. 3 is a cross-sectional view of an embodiment of the present invention.

Please refers to FIGS. 2 and 3. In combination of the present invention, the circuit board 20 is lodged inside said housing 31; leads 40 connect said inside conductor 37 and outside one 38 of said joint 32 to said AD adaptor 21 respectively; the speaker 10 is then set in the remaining space inside said housing 31 and connected to said amplification circuit 23 of said circuit board 20 with leads 40; then the safeguard 33 combined to the opening 35 of said housing 31 can seal and form the bulb type speaker structure.

Figure 4:
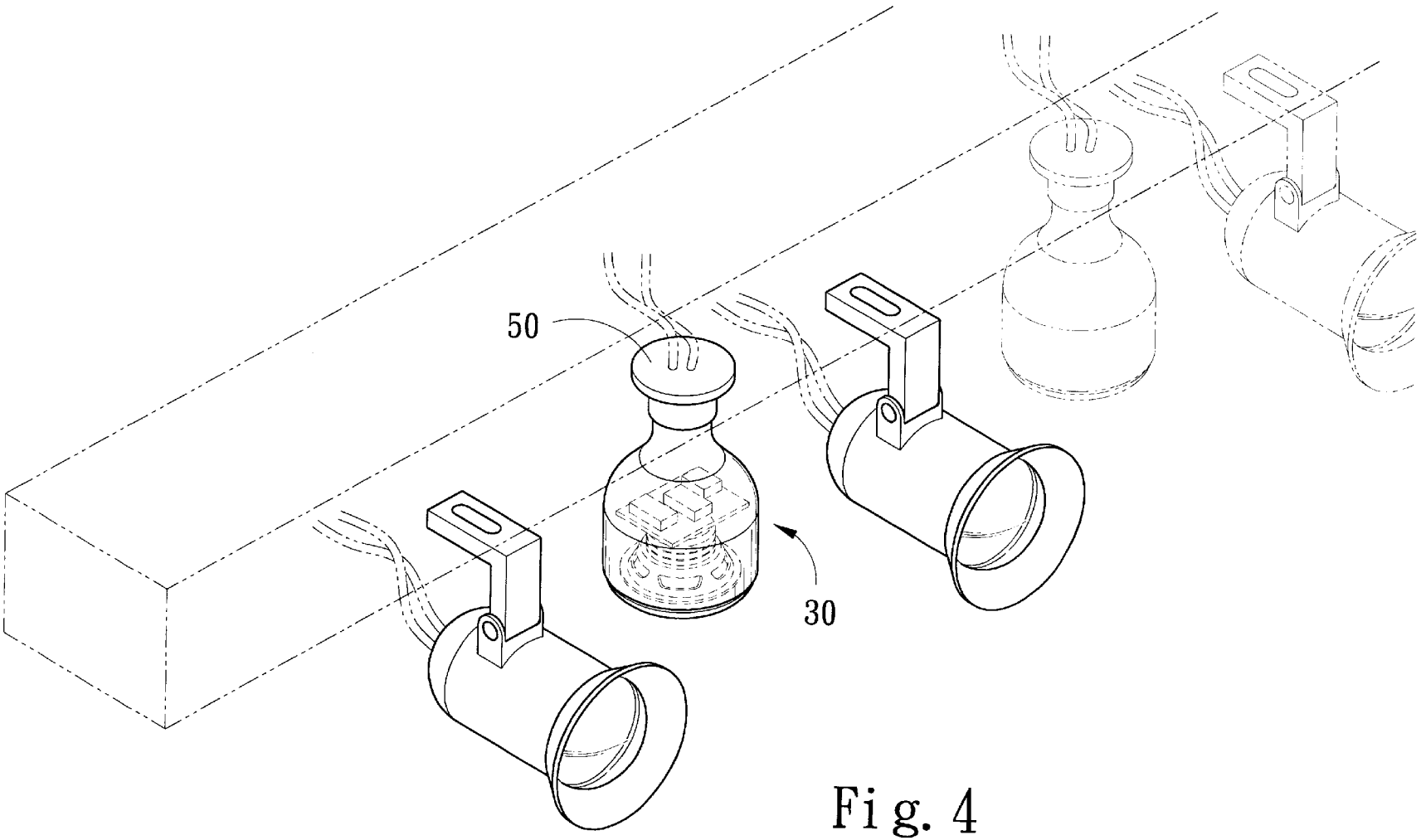
FIG. 4 is a diagram showing an example of the bulb type speakers according to the present invention in use.

Please refer to FIGS. 3, 3A and 4. The signal transmission of the present invention can be performed wirelessly, such as bluetooth technique, etc. In use it only has to wind the case body 30 into some lamp holder 50 commonly used. The power acquisition of said AD adaptor 21 is result from said two conductors 37 and 38 of said joint 32 linking to contacts inside said holder 50, and at the same time said AD adaptor 21 convert the household-use power supply into that for the speaker so as to drive said reception circuit 22 and said amplification circuit 23. Because this present embodiment is of wireless transmission mode, reception circuit 22 can receive some particular signals and convert them into voice frequency (VF) signals for delivering to said amplification circuit 23; by amplification circuit 23 enlarging the VF signals said speaker 10 is triggered to give off sound. The present invention is very convenient for arrangement and decorations of large-scale gatherings by hanging with ornaments and floodlight, etc.

Figure 5:
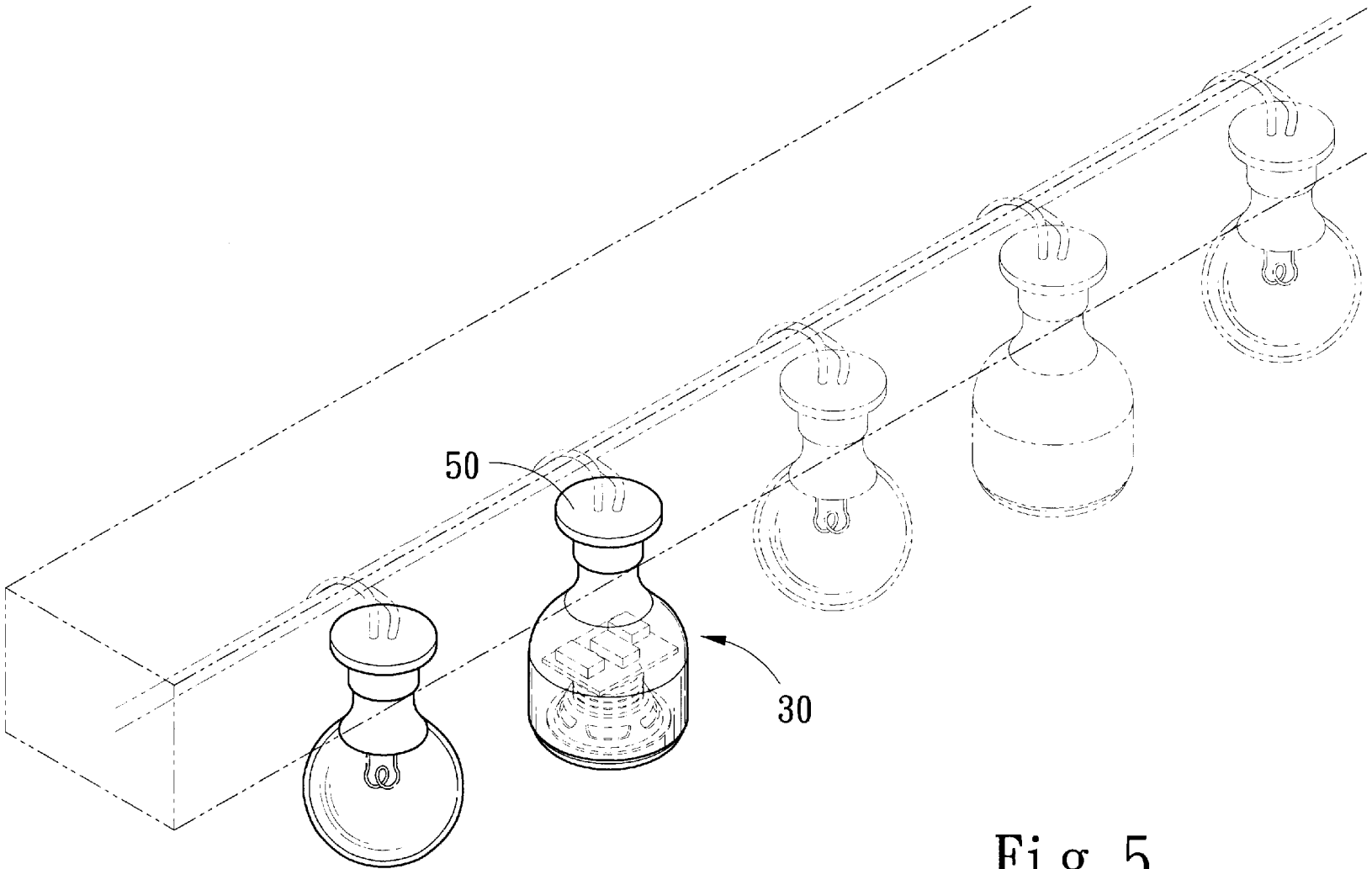
FIG. 5 is a diagram showing another example of the bulb type speakers according to the present invention in use.

Please refer to FIGS. 4 and 5. The present invention is to be equipped with a commonly used lamp holder 50 in use. Lamp holders 50 generally are established on ceiling or superior wall, therefore the present invention can be assembled easily with no need to install additional holder or stands and will not occupy living space. Further more, it is plug-and-play and very mobile that the present invention can be installed in a holder 50 anywhere. Moreover, because the present invention is of wireless transmission mode and has an amplifier inside, i.e. the whole speaker has included active-amp inside, the consuming of transmission lines is decreased and is convenient to collocate with DVD, CD, etc.

Besides, 1n the reception circuit 22 of the present invention can also establish a controlling circuit to regulate functions as switch of power supply, volume dimension, and so on to increase its facility. And its case body 30 also can be designed as different outward appearance to promote pleasant impression and without hindering practicability.

Consequently, the present invention has various advantages as follow:

1. The present invention can be assembled so easily with no need to install additional holder or stands that the facility of use is improved.

2. It is plug-and-play and very mobile that the present invention can be installed in some bulb holder anywhere and will not occupy living space.

3. When using in large and outdoors place the present invention is convenient to install and to dispose with maneuverability.

The above embodiment is only used to illustrate the present invention, not intended to limit the scope thereof. Many modifications of the above embodiment can be made without departing from the spirit of the present invention.

What is claimed is:

1. A bulb type speaker structure comprising a speaker, a circuit board, and a case body; wherein said speaker can receive signals transmitted from said circuit board and produce sound;

said circuit board comprises an AD adaptor, a reception circuit, and an amplification circuit; said AD adaptor can transform the power supply of usual use into that used in the reception circuit and amplification circuit; said reception circuit can receive signals; said amplification circuit can enlarge the signals received and then transmit them to said speaker;

said case body has a housing, a joint, and a safeguard; said housing is a case with hollow room for accommodating said circuit board and said speaker; the front end of said housing has an opening combined with said safeguard, which is established to be a board; on another end of said housing there established said joint, which has inside and outside conductors to form an analogue of bulb adapters;

said circuit board is lodged inside of said housing; leads connect said inside conductor and said outside one of said joint to said AD adaptor respectively; said speaker is then set in the remaining space inside said housing and connected to said amplification circuit of said circuit board with leads; said safeguard is combined to the opening of said housing can seal and form the bulb type speaker structure.

2. The bulb type speaker structure of claim 1 wherein said reception circuit of said circuit board receives signals in wireless mode.

3. The bulb type speaker structure of claim 1 wherein said housing is designed as a pour bowl; on the surface of said safeguard there are plurality of sound holes benefit for sound transmission; there are whorls on the surface of said outside conductor by which to install the bulb type speaker into a bulb holder.

* * * * *